US009210766B2

(12) United States Patent
Vinkenvleugel et al.

(10) Patent No.: US 9,210,766 B2
(45) Date of Patent: Dec. 8, 2015

(54) METHOD OF IMPOSING A DYNAMIC COLOR SCHEME ON LIGHT OF A LIGHTING UNIT

(75) Inventors: Lucius Theodorus Vinkenvleugel, Veldhoven (NL); Martine Gabrielle Pythia van Beers, Nuenen (NL)

(73) Assignee: Koninklijke Philips N.V., Eindhoven (NL)

( * ) Notice: Subject to any disclaimer, the term of this patent is extended or adjusted under 35 U.S.C. 154(b) by 545 days.

(21) Appl. No.: 13/636,227

(22) PCT Filed: Mar. 17, 2011

(86) PCT No.: PCT/IB2011/051118

§ 371 (c)(1),
(2), (4) Date: Sep. 20, 2012

(87) PCT Pub. No.: WO2011/117786

PCT Pub. Date: Sep. 29, 2011

(65) Prior Publication Data

US 2013/0009549 A1 Jan. 10, 2013

(30) Foreign Application Priority Data

Mar. 26, 2010 (EP) ..... 10157970

(51) Int. Cl.
*H05B 37/02* (2006.01)
*H05B 33/08* (2006.01)

(52) U.S. Cl.
CPC ..... *H05B 37/02* (2013.01); *H05B 33/0863* (2013.01)

(58) Field of Classification Search
CPC ..... H05B 37/0218; H05B 37/02; H05B 37/0227; H05B 37/0272
USPC ..... 315/149
See application file for complete search history.

(56) References Cited

U.S. PATENT DOCUMENTS

| | | | | |
|---|---|---|---|---|
| 2004/0150994 | A1* | 8/2004 | Kazar et al. | 362/251 |
| 2009/0135021 | A1* | 5/2009 | Joosen | 340/825.22 |
| 2009/0278476 | A1* | 11/2009 | Baaijens | 315/297 |

FOREIGN PATENT DOCUMENTS

| | | | | |
|---|---|---|---|---|
| CN | 10199000 | A | 6/2008 | |
| CN | 10137564 | A | 2/2009 | |
| EP | 1734502 | A1 | 12/2006 | |
| JP | 2003504829 | A | 2/2003 | |
| JP | 2006258683 | A | 9/2006 | |
| JP | 2009230298 | A | 10/2009 | |
| WO | 2006134529 | A2 | 12/2006 | |
| WO | 2007004097 | A1 | 1/2007 | |
| WO | 2007085986 | A1 | 8/2007 | |
| WO | 2007105151 | A1 | 9/2007 | |
| WO | 2008059411 | A1 | 5/2008 | |
| WO | WO 2008059411 | A1 * | 5/2008 | H05B 37/02 |

* cited by examiner

*Primary Examiner* — Ryan Jager
(74) *Attorney, Agent, or Firm* — Meenakshy Chakravorty

(57) ABSTRACT

The invention provides a method of imposing a dynamic color scheme on light (311) of a lighting unit (300) arranged to generate light (311) of variable color. The method comprises: detecting with a sensor (210) a first color and a second color of a colored entity (100); and varying the color of the light (311) of the lighting unit (300) between the first color and the second color of the colored entity according to a time scheme. The invention further provides a color sensor unit (200) comprising a sensor (210) and a control unit (220) for use in such a method.

12 Claims, 2 Drawing Sheets

METHOD OF IMPOSING A DYNAMIC COLOR SCHEME ON LIGHT OF A LIGHTING UNIT

FIELD OF THE INVENTION

The invention relates to a method of imposing a dynamic color scheme on light of a lighting unit.

The invention also relates to a color sensor unit for use in such a method. The invention further relates to a lighting system that can be used to execute the method.

BACKGROUND OF THE INVENTION

Lighting control devices are known in the art. WO2007/004097, for instance, describes a device for wireless control of color of light emitted by a lighting system. The lighting system comprises signal receiving means and means for adjusting the color of light emitted from at least one lighting element, in response to a received color control signal from the device. The device for wireless control comprises means for generating color information data, said data being indicative of a desired color of light to be emitted by the lighting system, means for modulating a first carrier signal in accordance with the color information data, and means for transmitting said color control signal in the form of a beam of said first modulated carrier signal to the lighting system.

WO2008/059411 describes a lighting system including light sources and a light wand configured to control the light sources in response to user input. The light wand is configured to copy a light attribute of a first light provided from a first light source, and paste the copied light attribute into a second light source so that the second light source provides a second light having the light attribute of the first light.

SUMMARY OF THE INVENTION

A next step for colored light sources may be to add dynamic behavior, e.g. the color changes in time. However, adding the dynamic function may imply that the user interface (often the remote control) needs extra elements to activate the dynamic function, to choose preferred colors (including hue, saturation, brightness), to choose preferred effects, e.g. loop, bounce between two colors, fire effect, random, etc., and to choose the speed of the dynamic behavior. For instance, the desired time scheme may consist of a sequence of slow and fast transitions, or a modulation that consists of random transitions in order to mimic for example the dynamic light effect of a fire (place).

This may easily lead to extra buttons and a more complex user interface. The challenge is to offer the functionality in an easy-to-use and intuitive way.

Hence, it is an aspect of the invention to provide an alternative method to provide dynamic lighting, which preferably further at least partly obviates one or more of the above-described drawbacks.

Further, it is an aspect of the invention to provide a color sensor unit that can for instance be used in such a method, which color sensor unit preferably further at least partly also obviates one or more of the above-described drawbacks.

Yet a further aspect of the invention is to provide a lighting system, comprising the color sensor unit and the lighting unit, that may execute the method, and which lighting system also preferably at least partly obviates one or more of the above-described drawbacks.

In a first aspect, the invention provides a method of imposing a dynamic color scheme on light of a lighting unit, wherein the lighting unit is arranged to generate light of variable color, wherein the method comprises:

a. detecting with a sensor a first color and a second color of a colored entity; and b. varying the color of the light of the lighting unit between the first color and the second color of the colored entity according to a time scheme.

Hereby, the invention provides a method of offering the dynamic function in an easy-to-use and playful way to the user. More specifically, the method describes how to easily generate dynamic color loops.

The sensor thus (sequentially) detects at least two colors of a colored entity, and a control unit (see also below) imposes (sequentially) these colors on the color of the light of the lighting unit according to a specific time development (herein indicated as time scheme). The sensor can thus be used to copy a color of an entity to the color of the light of the lighting unit. However, this is not a simple copy of the color, but a dynamic feature is added, in the sense that at least two colors (of the entity) are copied, and imposed on the light of the lighting unit in a dynamic way. The dynamic change of colors is herein also indicated as "color scheme" or "dynamic loop" or "dynamic color loop", or "color loop".

The sensor comprises an optical sensor and is arranged to detect colors of entities, such as colored products or constructions, but especially of a color chart or color strip (see also below). For instance, the entity may comprise a color strip with a plurality of colors, like a sheet or chart or card having a strip with a plurality of colors or a plurality of strips with a plurality of colors.

An advantage of using strips with colors may for instance be that such strips may be compared with colors in an interior, and in this way, interior colors may be easily superimposed with the color of the light by detecting with the sensor a comparable or identical color from the strip.

The phrase "detecting with a sensor at least a first color and a second color of a colored entity" may also include embodiments wherein the first color is derived from a first colored entity and the second color is derived from a second colored entity. Hence, the phrase "detecting with a sensor at least a first color and a second color of a colored entity" may also refer to embodiments including "detecting with a sensor at least a first color and a second color of at least one colored entity".

The term "dynamic color scheme" in this context refers to the fact that the color of the light of the lighting unit varies during a certain period of time between the first color and the second color. The phrase "varying between the first color and the second color", especially indicates that the color of the light changes from the first color, via intermediate colors, to the second color. The lighting unit may for instance comprise a plurality of light sources, such as LEDs, having different colors of light. By tuning the intensity of the light sources with respect to time, the first color of the light may fade and the color of the light may transform into the second color. In this way, via intermediate colors, the light of the lighting unit switches from the first to the second color.

In an embodiment, the time scheme is derived from the time between measuring the first and the second color. Hence, in an embodiment the period of time between the generation of the two colors by the lighting unit is related to the period of time between detection of the first color and a second color of the colored entity. The term "related" includes an embodiment wherein the periods of time are substantially identical. However, the term "related" may also include an embodiment wherein there is a pre-defined factor between the two periods of time. For instance, the period of time between providing light of the first color and light of the second color by the lighting unit may be twice as long as the time between measuring the first color and the second color. Hence, in an embodiment the time scheme is predefined (especially in a processor unit of the control unit).

The control unit of the sensor unit may thus further be arranged to detect the time between measuring the first color and the second color and may be arranged to control according to predefined instructions and/or user input instructions (see also below) the period of time between the generation of the two colors by the lighting unit.

In yet another variant, the term "related" may also include an embodiment in which there is a factor between the two periods of time defined by a user, for instance via a user input device. In a specific embodiment, the sensor may also be able to recognize information. For instance, the sensor may be able to read bar codes. When an entity is used containing one or more time schemes indicated by information recognizable by the sensor, the time scheme may also be selected from such an entity. For instance, one may use a chart having one or more color strips with a plurality of colors, and having one or more time schemes, indicated with sensor readable information, such as (a) bar code(s). Hence, the invention may also include selecting the time scheme from an entity displaying a sensor-readable identifier of the time scheme. As will be clear to the person skilled in the art, the term "time scheme" may also refer to a plurality of time schemes. The entity may thus also indicate a plurality of time schemes (including sensor-readable identifiers).

The sensor detects a color of an entity and the control unit imposes that color on the color of the light of the lighting unit. As will be clear to the person skilled in the art, there may be slight variances between the color to be detected and the color imposed on the light of the lighting unit. In terms of CIE coordinates, the difference ($\Delta x$ and/or $\Delta y$) between the color(s) of the colored light of the lighting unit imposed by the control unit and the entity color(s) detected may for instance be in the range of 0.1 or smaller, preferably 0.05 and smaller. Thus, when the color(s) of the entity could be determined as CIE (x,y) (0.2,0.5), the color(s) of the corresponding light of the lighting unit could be in the range of CIE (x,y) (0.1-0.3, 0.4-0.6), preferably (0.15-0.25,0.45-0.55).

The sensor (unit; see below) is arranged to be able to detect at least two different colors of the entity. However, the sensor (unit) may also be able to detect a series of different colors, starting with a first color and ending with a second color, with a series of colors in between. Hence, in a specific embodiment, the invention provides a method comprising:

a. detecting with a sensor a series of colors of a colored entity, starting with a first color and ending with a second color; and
b. varying the color of the light of the lighting unit through the series of colors between the first color and the second color of the colored entity according to the time scheme.

In this way, the (sequentially) detected series of colors is imposed according to the time scheme as series of colors on the light of the lighting unit. As mentioned above, the at least two different colors may also be from different entities.

The invention further relates to a color sensor unit (herein also indicated as "sensor unit") comprising a sensor and optionally a control unit, wherein a. the sensor is arranged to be able to sense at least a first color and a second color of a colored entity and to generate a corresponding sensor signal to the control unit; and
b. wherein the control unit is arranged to vary, based on the sensor signal and a time scheme, the color of light of a lighting unit between the first color and the second color of the colored entity.

Such a color sensor unit can be used to detect the two or more colors of the colored entity or entities, and via the control unit, these colors are imposed on the light of the lighting unit. The color sensor unit may comprise a user input device, such as a (press or touch) button or other means, to select the color the sensor is detecting.

The sensor of the color sensor unit is at least able to detect different colors. Hence, this sensor may also be indicated as "color sensor". However, this sensor may also be able to detect other properties, such as the herein described unique identifiers belonging to time schemes.

In a specific embodiment, the control unit is arranged to communicate wirelessly with the lighting unit. To this end, the color sensor unit may comprise a transmitter, to transmit the control signal to (a receiver of) the lighting unit. In an alternative embodiment, wherein the control unit is not (entirely) comprised by the sensor unit, the color sensor unit may comprise a transmitter, to transmit the sensor signal to (a receiver of the) control unit; the control unit then generates a control signal to (a receiver of) the lighting unit. In this way, the sensor unit can be used as remote control of the lighting unit, which has the feature that a detected color can be imposed on the light of the lighting unit. Hence, in a specific embodiment, the sensor unit is a remote control of the lighting unit, further comprising the ability to sense at least a first color and a second color of a colored entity and to control the color of light of the lighting unit between the first color and the second color of the colored entity according to a time scheme.

The control unit may be integrated in the sensor unit, but may also be integrated in the lighting unit. In another embodiment, the control unit comprises a plurality of control units that are arranged to vary, based on the sensor signal and a time scheme, the color of light of a lighting unit between the first color and the second color of the colored entity. These control units may communicate which each other (wirelessly). In a further embodiment, the control unit comprises a first control unit integrated in the color sensor and a second control unit integrated in the lighting unit, wherein the first control unit and the second control unit together are arranged to vary, based on the sensor signal and a time scheme, the color of light of a lighting unit between the first color and the second color of the colored entity. Hence, in an embodiment, the execution of the dynamic color scheme may for instance be done in a receiver unit at the lighting unit, wherein such a receiver unit further comprises a control unit. In such an embodiment, the color sensor unit may transmit the detected dynamic color scheme to the receiver unit which executes the dynamic color scheme. In this way the color sensor unit may for instance go into sleep mode in order to save battery power.

In a specific embodiment, the control unit is integrated in the sensor unit. Hence, the invention also provides a color sensor unit comprising a sensor and a control unit, wherein (a) the sensor is arranged to be able to sense at least a first color and a second color of a colored entity and to generate a corresponding sensor signal to the control unit; and (b) the control unit is arranged to vary, based on the sensor signal and time scheme, the color of light of a lighting unit between the first color and the second color of the colored entity.

As mentioned above, this time scheme may be predefined or may be defined by a user. Especially in the latter case, the sensor unit may be equipped with a user input device, arranged to select a time scheme (or a series of time schemes).

Hence, in an embodiment, the sensor is further arranged to be able to select the time scheme from an entity displaying a sensor-readable identifier of the time scheme. The term "user input device" may in an embodiment also refer to a plurality of user input devices. The user input device may also be used to control the intensity of the light of the lighting unit.

The sensor unit may further comprise an indicator, which may for instance indicate the time scheme or the selected colors, or both. The indicator may also be used to indicate battery load or reach of the color sensor unit (i.e. whether the lighting unit is detected well).

Such an indicator may for instance be a display, but may alternatively be a series of LEDs. Hence, in a specific embodiment, the color sensor unit may further comprise an indicator, such as a display, arranged to indicate the first color and the second color. The indicator may be arranged to indicate (simultaneously) the first and the second color at different parts of the indicator, but may alternatively also be arranged to indicate the first and the second color sequentially. Further, the indicator may also be arranged to indicate a whole series of colors. Whereas the lighting unit may especially include solid state LEDs as light source(s), the indicator may especially include solid state LEDs and/or organic LEDs, especially organic LEDs (OLEDs).

In a further embodiment, the color sensor unit further comprises an indicator arranged to indicate the time scheme. Hence, the sensor unit may comprise one or more indicators. In an embodiment, the indicator may be used to indicate the color and the time scheme (at the same time or sequentially).

In a specific embodiment, the color sensor unit may further comprise a user input device for selecting a time scheme. This may be a (touch or press) button or a scroll wheel. One and the same user input device may have more than one function, such as selecting the color the sensor is detecting and selecting a time scheme (for instance, a time scheme of which the sensor detects the unique identifier belonging to that time scheme). The user input device (such as a button or a scroll wheel) may also be used to switch between types of information (e.g. color(s), color range, time scheme) provided by the indicator.

The control unit may further comprise a memory arranged to store information of one or more of (a) the selected set of colors and (b) the time scheme. As mentioned above, the control unit may be integrated in the sensor unit, but may also be arranged remote from the sensor unit, such as in the lighting system.

The color sensor unit may further comprise a (small) light source arranged to illuminate the entity of which the color is to be detected by the sensor unit. Hence, when using the sensor unit to detect a color of an entity, the light source may be switched on to illuminate the entity.

The invention also relates to combinations of devices, which may not necessarily be physically connected, but which may be arranged to communicate, such as (1) a combination of the lighting unit and the color sensor unit, (2) a combination of the lighting unit and the color sensor unit and an entity comprising a color strip with a plurality of colors, and (3) a combination of the color sensor unit and an entity comprising a color strip with a plurality of colors.

In a further aspect, the invention therefore provides a lighting system comprising (i) a color sensor unit comprising a sensor, (ii) a control unit, and (iii) a lighting unit arranged to generate light of variable color, wherein (a) the sensor is arranged to be able to sense at least a first color and a second color of a colored entity and to generate a corresponding sensor signal to the control unit; and (b) wherein the control unit is arranged to vary, based on the sensor signal and time scheme, the color of light of the lighting unit between the first color and the second color of the colored entity.

As mentioned above, the control unit may be integrated in the sensor unit, but may also be integrated in the lighting unit. In principle, the control unit may also be a separate device, receiving a sensor signal from the sensor unit, processing that signal into a corresponding rendering signal to the (receiver of the) lighting unit to vary, based on the sensor signal and time scheme, the color of light of the lighting unit between the first color and the second color of the colored entity. Likewise, the control unit may comprise a first control unit integrated in the color sensor and a second control unit integrated in the lighting unit, wherein the first and the second control unit are arranged to vary, based on the sensor signal and time scheme, the color of light of the lighting unit between the first color and the second color of the colored entity.

Hence, in a specific embodiment, the invention provides a lighting system comprising (a) a color sensor unit (comprising a control unit) as defined herein and a lighting unit (b) arranged to generate light of variable color, wherein the color of the light of the lighting unit is controllable by the color sensor unit. In yet a further aspect, the invention also provides a "kit of parts" comprising the color sensor unit (comprising a control unit) as defined herein, and an entity comprising a color strip with a plurality of colors. Note that the lighting system of the invention is in fact also a "kit of parts".

With the method and device of the invention, a dynamic function may be added in an intuitive way to lighting. Preferred colors (including hue, saturation, brightness) may be chosen and preferred effects may be chosen (including "inducing the desired effect), e.g. loop, bounce between two colors, fire effect, random, etc., and also the speed of the dynamic behavior may be chosen.

BRIEF DESCRIPTION OF THE DRAWINGS

Embodiments of the invention will now be described, by way of example only, with reference to the accompanying schematic drawings in which corresponding reference symbols indicate corresponding parts, and in which.

DESCRIPTION OF PREFERRED EMBODIMENTS

Figure 1:
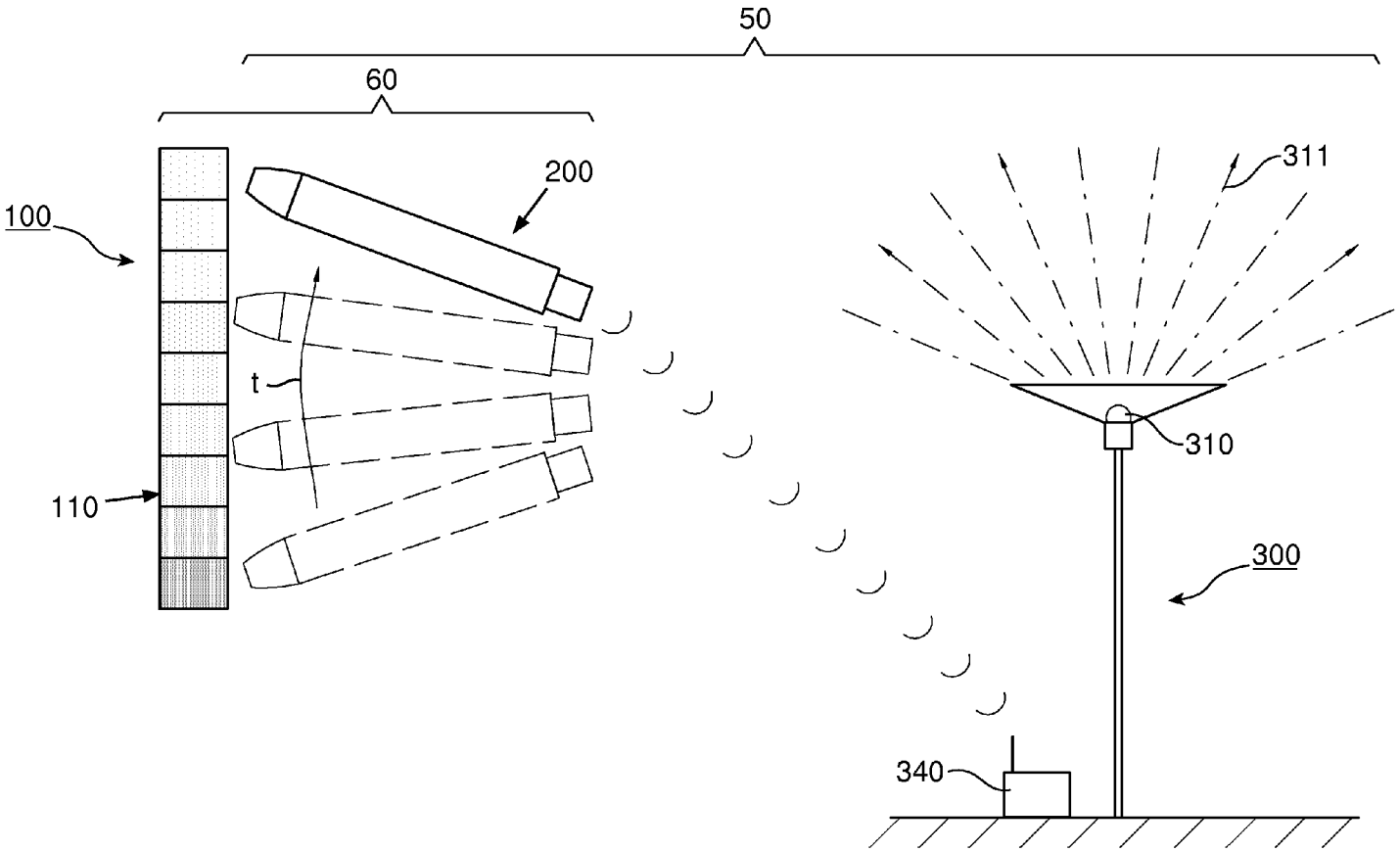
FIG. 1 schematically depicts an embodiment of the entity with color strip, color sensor unit and lighting unit.

FIG. 1 schematically depicts on the left an embodiment of the colored entity, indicated with reference 100. In this embodiment, the colored entity 100 comprises a color strip 110 with a plurality of colors. In the middle, a pen-like device is schematically depicted, which is schematically shown to move with time t along the color strip 110. In this way, a series of colors, starting with a first color and ending with a second color may be detected. The pen-like device is an embodiment of the color sensor unit, indicated with reference 200.

The combination of color sensor unit 200 and entity 100 comprising a colored strip 110 is indicated with reference 60, and is herein also described as a kit of parts of color sensor unit 200 and colored entity 100.

The color sensor unit 200 is arranged to detect two or more colors of the colored entity 100 and impose (by means of a control unit, see below) those colors on the light of a lighting unit. On the right in this Figure, a lighting unit 300 is schematically depicted. This lighting unit 300 comprises a light source 310. During operation, the lighting unit 300 (or more accurately in this case, the light source 310 of the lighting unit 300) provides light 311. The color of this light 311 is controlled by the color sensor unit 200, for instance wirelessly. To receive the control signal of the color sensor unit 200, the lighting unit may further comprise a receiver 340, arranged to receive a control signal of the control unit (see below). The combination of lighting unit 300 and color sensor unit 200 is herein also indicated as lighting system 50.

Figure 2:
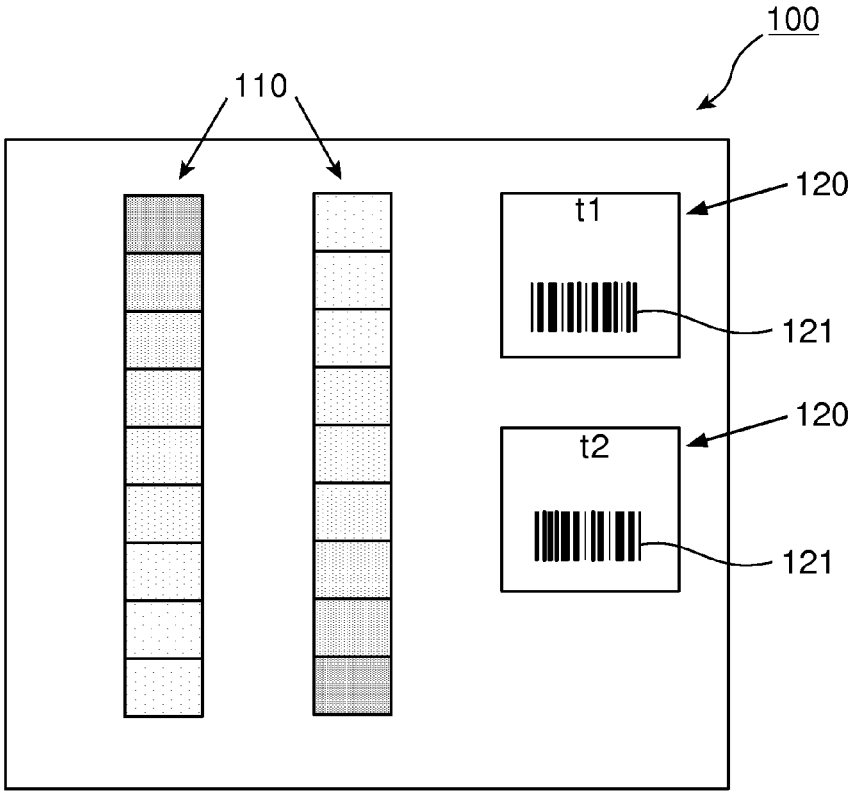
FIG. 2 schematically depicts in more detail an embodiment of the entity with color strip.

FIG. 2 schematically depicts an embodiment of the colored entity 100 with the color strip 110. Here, the embodiment comprises by way of example two color strips 110, for instance one showing a plurality of colors from blue to green and one showing a plurality of colors from yellow to orange. By way of example, a schematic variant is depicted, wherein the colored entity 100 further comprises a time scheme 120 (here by way of example two time schemes are depicted), with each a sensor-readable identifier 121 (here depicted as bar codes). In this schematic embodiment, the colored entity 100 and the entity displaying the sensor-readable identifier 121 of the time scheme 120 are integrated in one entity, but as will be clear to the person skilled in the art, also two (or more) separate entities may be used.

Here the depicted colored entity 100 allows the color sensor unit 200 (not depicted) to sense a first color and a second color (from one or more of the colored strips 110) and to select the time scheme 120 from the sensor-readable identifier 121 of the time scheme 120. By way of example, the time scheme may be a specific time, such as 10 seconds or one minute, but may also be a scheme wherein the color loop (of for instance 10 seconds or a minute) is repeated over and again, or repeated in forward and backward mode to create a bounce loop.

Figure 3:
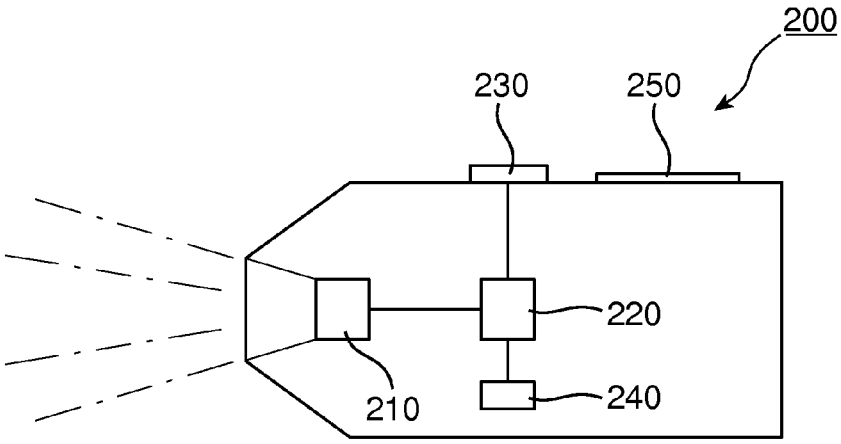
FIG. 3 schematically depicts an embodiment of the color sensor unit.

FIG. 3 schematically depicts (in cross section) in more detail an embodiment of the color sensor unit 200. The color sensor unit 200 comprises a sensor 210 and in this schematically depicted embodiment also a control unit 220. The sensor 210 is arranged to be able to sense a first color and a second color (of a colored entity; see FIGS. 1 and 2) and to generate a corresponding sensor signal to the control unit 220. The control unit 220 is further arranged to vary, based on the sensor signal and a time scheme, the color of light 311 of a lighting unit 300 (see FIG. 1) between the first color and the second color of the colored entity 100 (see FIGS. 1 and 2). The color sensor unit 200 may further comprise a transmitter 240, arranged to transmit (wirelessly) the control signal to receiver 340 of lighting unit 300 (see FIG. 1). As mentioned above, the sensor 210 may also be arranged to read the unique identifiers 121 of color schemes on an entity.

The color sensor unit 200 may further comprise an indicator 250, such as a display, for indicating information such as battery load, time scheme, color(s), etc. Further, the color sensor unit 200 may comprise a user input device 230, such as a (press) or touch button, or a scroll wheel, etc.

The color sensor unit 200 may for instance have the shape of a pen.

How the color sensor unit 200 may be applied is described below in an example, with specific reference to FIG. 3.

The color sensor unit 200 includes the (color) sensor 210. By pressing a button and moving the color sensor unit 200 over a color strip 110, the color sensor unit 200 reads-in the color settings for the dynamic color loop. Via for instance RF-communication, the color sensor unit 200 transfers the (settings of the) dynamic color loop to a device that can play the dynamic color loop, i.e. the lighting unit 300 (see also FIG. 1).

A big advantage of this method is that the user very easily can create a dynamic color loop that fits a certain interior. For example the color strip can be put in a magazine next to a picture of an interior. An alternative solution can be that the characteristics of the dynamic color loop are integrated in the color sensor unit 200; the action to be performed by the user is to read-in two (or more) distinct colors for the color strip, for example the start color and the middle color of the color strip. The color sensor unit 200 may then generate a fluent dynamic color loop based on these distinct colors. The user needs to define the colors with the color sensor unit 200, for example by putting the color sensor unit 200 in two locations of a picture or a color strip. Also colored interior items may be used to detect the colors. Here, the term color loop especially refers to the change from first color to second color of the light of the lighting unit in a specific time, for instance the time used to detect the first and the second colors.

An additional function for the color sensor unit 200 is to increase/decrease the speed of the color loop (relative to a color loop where the time is defined by the time used to detect the first and the second colors). This can be done in many ways, for example with buttons, a scroll wheel, or gestures like rotating the color sensor unit 200 or moving the pen up/down. Another option is to integrate the color sensor unit 200-functions in a remote control, for example the Living-Colors™ remote control (see for instance WO 2007/105151). An enhancement of the method may be to show the dynamic color loop on the color sensor unit 200, for example with a few LEDs and a light guide (i.e. with the indicator 250). In this way the user gets feedback as to which dynamic color loop is created and/or selected. Another enhancement is the possibility to store the dynamic color loops in the color sensor unit 200, so that the user can (re-)store his/her favorite color loops. This may be done in the (memory of the) control unit 220.

With reference to the schematic FIGS. 1 and 3, it is mentioned that other embodiments are also possible. For instance, the control unit 220 may be integrated in the sensor unit 200, but the control unit 220 may also be integrated in the lighting unit 300. In principle, the control unit 220 may also be a separate unit, or consist of a plurality of units, one of which may be integrated in the lighting unit 300 and another one of which may be integrated in the sensor unit 200. For instance, the sensor unit 200 may transmit the sensor signal via transmitter 240 to the control unit 220 integrated in the lighting unit (not depicted) (more precisely, to the receiver unit 340 of the lighting unit 300). The control unit 220, if integrated in the lighting unit 300, and the receiver unit 340, may be a single integrated unit, preferably integrated in the lighting unit 300.

The invention can be applied for colored light devices (lamps, luminaries) in homes, but can also be applied for shops and hospitality applications.

The term "substantially" herein, such as in "substantially all emission" or in "substantially consists", will be understood by the person skilled in the art. The term "substantially" may also include embodiments with "entirely", "completely", "all", etc. Hence, in embodiments the adjective "substantially" may also be removed. Where applicable, the term "substantially" may also relate to 90% or higher, such as 95% or higher, especially 99% or higher, even more especially 99.5% or higher, including 100%. The term "comprise" includes also embodiments wherein the term "comprises" means "consists of".

Furthermore, the terms first, second, third and the like in the description and in the claims, are used for distinguishing between similar elements and not necessarily for describing a sequential or chronological order. It is to be understood that the terms so used are interchangeable under appropriate circumstances and that the embodiments of the invention described herein are capable of operation in other sequences than described or illustrated herein.

The devices herein are amongst others described during operation. As will be clear to the person skilled in the art, the invention is not limited to methods of operation or devices in operation.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "to comprise" and its conjugations does not exclude the presence of elements or steps other than those stated in a claim. The article "a" or "an" preceding an element does not exclude the presence of a plurality of such elements.

The invention may be implemented by means of hardware comprising several distinct elements, and by means of a suitably programmed computer. In the device claim enumerating several means, several of these means may be embodied by one and the same item of hardware.

The mere fact that certain measures are recited in mutually different dependent claims does not indicate that a combination of these measures cannot be used to advantage.

The invention claimed is:

1. A method of imposing a dynamic color scheme to light of a lighting unit arranged to generate light of variable color, the method comprising:

a. detecting with a sensor at least a first color and a second color of a colored entity; and b. varying the color of the light of the lighting unit between the first color and the second color of the colored entity according to a time scheme, wherein a period of time between generation of the two colors by the lighting unit is related to a period of time between detection of the first color and detection of the second color.

2. The method according to claim 1, wherein the colored entity comprises a color strip with a plurality of colors.

3. The method according to claim 1, wherein the time scheme is predefined.

4. The method according to claim 1, comprising:

a. detecting with the sensor a series of colors of a colored entity, starting with a first color and ending with a second color; and b. varying the color of the light of the lighting unit through the series of colors between the first color and the second color of the colored entity according to the time scheme.

5. A method of imposing a dynamic color scheme to light of a lighting unit arranged to generate light of variable color, the method comprising:

a. detecting with a sensor at least a first color and a second color of a colored entity; and b. varying the color of the light of the lighting unit between the first color and the second color of the colored entity according to a time scheme, wherein the time scheme is selected from an entity displaying a sensor-readable identifier of the time scheme.

6. A color sensor unit comprising a sensor and a control unit, wherein a. the sensor is configured to sense at least a first color and a second color of a colored entity and to generate a corresponding sensor signal to the control unit; and b. wherein the control unit is configured to vary, based on the sensor signal and a time scheme, the color of light of a lighting unit between the first color and the second color of the colored entity, wherein the sensor is further configured to be able to select the time scheme from an entity displaying a sensor-readable identifier of the time scheme.

7. The color sensor unit according to claim 6, wherein the color sensor unit further comprises an indicator arranged to indicate the first color and the second color.

8. The color sensor unit according to claim 6, wherein the color sensor unit further comprises a user input device for selecting a time scheme.

9. The color sensor unit according to claim 6, wherein the color sensor unit further comprises a memory arranged to store information of one or more of (a) the sensed colors and (b) the selected time scheme.

10. The color sensor unit according to claim 6, wherein the control unit is arranged to communicate wirelessly with the lighting unit.

11. A color sensor unit comprising a sensor and a control unit, wherein a. the sensor is configured to sense at least a first color and a second color of a colored entity and to generate a corresponding sensor signal to the control unit; and b. the control unit is configured to vary, based on the sensor signal and a time scheme, the color of light of a lighting unit between the first color and the second color of the colored entity, wherein the color sensor unit further comprises an indicator arranged to indicate the time scheme.

12. A lighting system comprising a color sensor unit comprising a sensor, a control unit, and a lighting unit arranged to generate light of variable color, wherein a. the sensor is configured to be able to sense at least a first color and a second color of a colored entity and to generate a corresponding sensor signal to the control unit; and b. the control unit is configured to vary, based on the sensor signal and time scheme, the color of light of the lighting unit between the first color and the second color of the colored entity; and wherein the sensor is further configured to be able to select the time scheme from an entity displaying a sensor-readable identifier of the time scheme, or the color sensor unit further comprises an indicator arranged to indicate the time scheme.

* * * * *